US006413915B1

(12) United States Patent
Stehr

(10) Patent No.: US 6,413,915 B1
(45) Date of Patent: Jul. 2, 2002

(54) LUBRICANT

(75) Inventor: Werner Stehr, Horb-Ahldorf (DE)

(73) Assignee: ZF Lemförder Metallwaren AG (DE)

( * ) Notice: Subject to any disclaimer, the term of this patent is extended or adjusted under 35 U.S.C. 154(b) by 0 days.

(21) Appl. No.: 09/807,259

(22) PCT Filed: Aug. 10, 2000

(86) PCT No.: PCT/DE00/02728

§ 371 (c)(1),
(2), (4) Date: Apr. 9, 2001

(87) PCT Pub. No.: WO01/10985

PCT Pub. Date: Feb. 15, 2001

(30) Foreign Application Priority Data

Aug. 10, 1999 (DE) ..... 199 37 657

(51) Int. Cl.[7] ..... C10M 171/06
(52) U.S. Cl. ..... 508/181; 508/551; 508/591
(58) Field of Search ..... 508/181

(56) References Cited

U.S. PATENT DOCUMENTS

| | | | | |
|---|---|---|---|---|
| 4,204,968 A | | 5/1980 | Mack et al. | 508/150 |
| 4,486,319 A | * | 12/1984 | Jamison | 508/181 |
| 4,834,894 A | | 5/1989 | Scheld | 508/183 |
| 4,888,122 A | | 12/1989 | McCready | 508/165 |
| 5,160,646 A | * | 11/1992 | Scheld | 508/181 |
| 5,188,764 A | * | 2/1993 | Shimizu et al. | 508/181 |
| 5,554,308 A | | 9/1996 | Masaie et al. | 508/181 |
| 5,565,417 A | * | 10/1996 | Salvia | 508/167 |
| 5,624,887 A | * | 4/1997 | Nakamaru et al. | 508/108 |
| 5,670,461 A | * | 9/1997 | Schreiber et al. | 508/117 |
| 5,744,539 A | * | 4/1998 | McCoy et al. | 524/546 |
| 5,863,875 A | * | 1/1999 | Steckel | 508/551 |
| 6,017,857 A | * | 1/2000 | Heimann et al. | 508/136 |
| 6,066,601 A | * | 5/2000 | Steckel | 508/181 |
| 6,121,208 A | * | 9/2000 | Toyota | 508/106 |

FOREIGN PATENT DOCUMENTS

| | | |
|---|---|---|
| DE | 198 39 296 A1 | 3/2000 |
| JP | 63172795 | 7/1988 |

* cited by examiner

*Primary Examiner*—Ellen M. McAvoy
(74) *Attorney, Agent, or Firm*—McGlew and Tuttle, P.C

(57) ABSTRACT

The present invention pertains to a lubricant for a ball-and-socket joint, wherein spherical particles of two different sizes are introduced into an oil or a lubricating grease. The coarser particles act as spacers, which prevent the ball of the ball-and-socket joint from lying on a bearing shell during standstill of the ball-and-socket joint. The finer particles prevent the coarser particles from agglomerating and keep the coarser particles spaced apart from one another and they also keep them distributed in the ball-and-socket joint as a result.

18 Claims, No Drawings

LUBRICANT

FIELD OF THE INVENTION

The present invention pertains to a lubricant containing particles, especially a liquid lubricant such as an oil or a lubricating grease containing particles of two different particles sizes, wherein the difference between the sizes of the particles is in the range of 1:100 or higher.

BACKGROUND OF THE INVENTION

The lubricant is intended especially for use in ball-and-socket joints which are used, e.g., in steering linkages of motor vehicles. Use of the lubricant in other bearings or for other lubrication purposes is also possible.

Lubricants which contain particles with two different particle sizes have been known from JP-A 63 172 795, U.S. Pat. No. 4,888,122 or DE 198 39 296 A1. The difference in the size of the particles may be in the range of 1:100 or more. The purpose of the lubricant according to the first document mentioned is good heat resistance and lubrication properties at high temperatures as well as high stress. The purpose of the lubricant according to the second document mentioned is to coat porous bearing surfaces of an internal combustion engine with the particles in order to smooth the surface. The purpose of the third document mentioned is to damp rattling vibrations especially in self-locking transmissions of hinge mounts on vehicle seats. The prior-art lubricants are not intended specifically for ball-and-socket joints and do not solve the problems described below which occur in ball-and-socket joints.

If a ball-and-socket joint that is at rest is to be moved (pivoted), a type of breakaway torque, i.e., an increased torque must first be applied in order to set in motion a ball socket of a ball-and-socket joint in relation to a ball of the ball-and-socket joint. When the ball socket is moving in relation to the ball, the torque decreases, doing so usually abruptly, to considerably less than half of the breakaway torque. The beginning of the pivoting of the ball-and-socket joint from the state of rest is accompanied by a jerk, which can be felt in some cases and is sometimes also audible as a clicking. This jerk and the breakaway torque at the beginning of the pivoting of the ball-and-socket joint from the state of rest is explained by the ball of the ball-and-socket joint displacing grease or another lubricant from a point of the ball-and-socket joint with the ball-and-socket joint at rest. The lubricating film thickness decreases in this point to a fraction of the lubricating film thickness present in the moving ball-and-socket joint, and the lubricating film thickness drops to zero in the extreme case. The reduction in the lubricating film thickness is time-dependent. The friction of the ball-and-socket joint increases, e.g., threefold to fourfold with decreasing lubricating film thickness. This high friction must be overcome at the beginning of the pivoting of the ball-and-socket joint. When the ball is moving in the ball socket, lubricant is distributed over the surface of the ball, as a result of which the friction of the ball-and-socket joint decreases.

To manufacture a ball-and-socket joint, the ball socket is first manufactured as a hemisphere with a hollow cylindrical edge attached in one piece and smoothly to the hollow hemisphere in order to insert the ball into the ball socket. After the ball has been inserted into the ball socket, the hollow cylindrical edge is deformed inwardly, so that the ball socket surrounds the ball over more than a hemispherical surface and thus holds it by extending behind it in a positive-locking manner. A friction-reducing bearing shell made of plastic, e.g., polyacetate (POM), is often placed into the ball socket. A lubricant, mostly a lubricating grease, is applied to the ball and/or the ball socket or the bearing shell before the ball is introduced into the ball socket. After the ball has been placed into the ball socket and the hollow cylindrical edge of the ball socket has been deformed inwardly to enclose the ball, the ball-and-socket joint is heated. The purpose of this is to adapt the bearing shell to the shape of the ball. A gap between the ball and the ball socket, which is necessary for the pivotability of the ball-and-socket joint, becomes established due to the fact that the hollow cylindrical edge of the ball socket will again expand after the deformation in the inward direction.

The problem arises that a gap becomes established between the ball and the ball socket during the deformation. However, this spontaneous establishment of the gap between the ball and the ball socket is inaccurate and may adversely affect the parameters of the ball-and-socket joint.

SUMMARY AND OBJECTS OF THE INVENTION

The basic object of the present invention is to provide a lubricant which makes possible the accurate establishment of the gap between the ball and the ball socket during the manufacture of a ball-and-socket joint.

According to the invention, a lubricant is provided containing particles of two different particles sizes. The difference between the sizes of the particles is in the range of 1:100 or higher. The coarser particles have a lower dissolution temperature in the lubricant than do the finer particles.

The dissolution temperature is the temperature beginning from which the particles become dissolved in the lubricant or, what actually happens to the particles, the particles disappear when the particles are viewed under the microscope and, what is essential, they no longer reappear after the lubricant is cooled to below the dissolution temperature. After heating and optionally holding the lubricant at the dissolution temperature of the coarser particles and subsequent cooling, the coarser particles are no longer present as such. It is thus possible to dissolve the coarser particles by heating the lubricant according to the present invention to or above the dissolution temperature of the coarser particles but not to the dissolution temperature of the finer particles and by holding the lubricant at this temperature. The lubricant according to the present invention has the following advantage during the manufacture of a ball-and-socket joint: The coarser particles of the lubricant keep the ball socket at a spaced location from the ball during the deformation of the hollow cylindrical ball socket to enclose the ball of the ball-and-socket joint seated in the ball socket. The gap present between the ball socket and the ball after the deformation of the ball socket can be set very accurately by selecting the diameter of the coarser particles. The ball-and-socket joint is subsequently heated to the dissolution temperature of the coarser particles and held temporarily at this temperature, as a result of which the coarser particles dissolve, whereas the finer particles with the higher dissolution temperature continue to be present. Since the coarser particles are not formed again after the cooling of the lubricant, only the finer particles will remain in the lubricant and form the spacers, which maintain the distance (gap) between the ball and the ball socket even when the ball-and-socket joint is at rest, to prevent the ball from lying on the ball socket and thus avoid the breakaway torque of the ball-and-socket joint.

Coarser particles and a bearing shell whose dissolution temperatures or softening points are approximately equal and are lower than the dissolution temperature of the finer particles are preferably selected. In the case of polyacetate (POM) as the material of the bearing shell, which softens at approximately 100° C. and begins to melt beginning from approx. 120° C., the coarser particles selected for the lubricant according to the present invention have a dissolution temperature of approx. 80–100° C. and the finer particles selected have a dissolution temperature of approx. 120° C. The coarser particles are made of, e.g., polyethylene and the finer particles from polyamide with a higher dissolution temperature in the lubricant.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE INVENTION

The invention comprises a lubricant, e.g., an oil or a lubricating grease, into which particles are introduced distributed uniformly, e.g., by stirring in. The coarser particles selected for the lubricant according to the present invention have a dissolution temperature of approx. 80–100° C. and the finer particles selected have a dissolution temperature of approx. 120° C. The coarser particles are made of, e.g., polyethylene and the finer particles from polyamide with a higher dissolution temperature in the lubricant. The particles preferably have a round shape, they are preferably spherical. Based on the particle size, the particles are in the form of powders, which are stirred into the lubricant. The coarser particles form spacers of a kind. This ensures a distance between the ball and the ball socket or generally a distance between two bodies between which the lubricant is located as long as they are not dissolved in the lubricant. The finer particles are located between the coarser particles and keep these at a distance from one another. The lubricant is located in the spaces between the particles. The finer particles prevent the coarser particles from agglomerating, i.e., they prevent the coarser particles from accumulating in one or more points, e.g., in the gap between a ball and a ball socket of a ball-and-socket joint. As a result, the finer particles keep the coarser particles distributed in the gap of the ball-and-socket joint. A minimum gap width, which corresponds to the diameter of the coarser particles and brings about a friction that is not higher or is only slightly higher at the beginning of the pivoting of the ball-and-socket joint than during the pivoting, is ensured at any point. An increase in friction at the beginning of the pivoting of the ball-and-socket joint to a value that is several times the friction of the moving ball-and-socket joint is avoided even after no movement for a long time. A jerky onset of movement or clicking noises are avoided. Even though provisions are made according to the present invention for the lubricant to contain particles of only two different particles sizes, it is not disturbing if particles of possibly other particle sizes are also present in the lubricant. This shall not be excluded from the present invention. The suitable particles are lubricant particles, plastics such as polymers, e.g., polyamide (PA), polyethylene (PE), poly[t]etrafluoroethylene (PTFE) and/or other particles, and the particles preferably have a spherical shape.

The difference in size between the particles in the lubricant according to the present invention is 1:100 or higher, the size difference being defined as the difference in the diameters or the difference in another, characteristic dimension of the particles. In one embodiment of the present invention, the particles of different size have a different (apparent) surface tension. As a result, the particles with the lower surface tension quasi wet the particles with the higher surface tension.

The finer particles preferably have a lower surface tension than the coarser particles, so that these will quasi wet the coarser particles because of their lower surface tension. They adhere in a distributed form to the surface of the coarser particles with the higher surface tension, which means that the coarser particles are coated with the finer particles.

The change in the surface tension can be brought about by means of an additive ("friction modifier" or catalyst).

Agglomeration, i.e., the accumulation especially of the coarser particles is thus prevented from occurring according to the present invention and the desired distribution especially of the coarser particles forming the spacers in the lubricant is achieved. The difference in the surface tensions of the finer and coarser particles is selected to be such that the desired, distributed arrangement of the finer particles on the surface of the coarser particles takes place and the agglomeration fails to take place. Since a comparable effect is conceivable at the inverse surface tension ratio, the case in which the surface tension of the coarser particles is lower than the surface tension of the finer particles shall not be excluded. The difference between the surface tensions of the particles of different size must be present in the lubricant regardless of whether this surface tension is also effective in the absence of the lubricant.

An example of such a lubricant according to the present invention is a lubricating grease into which spherical particles consisting of polyethylene and poly[t]etrafluoroethylene are stirred, wherein the particles consisting of polyethylene have a diameter that is approx. 100 times the diameter of the particles consisting of poly[t]etrafluoroethylene. Before being stirred into the lubricating grease, the particles are in the powdered form. Due to the higher (apparent) surface tension of polyethylene and the low (apparent) surface tension of poly[t]etrafluoroethylene, the finer particles consisting of poly[t]etrafluoroethylene adhere to the surface of the polyethylene particles, which are approx. 100 times larger, in a distributed manner and prevent the coarser particles consisting of polyethylene from being agglomerated.

While specific embodiments of the invention have been shown and described in detail to illustrate the application of the principles of the invention, it will be understood that the invention may be embodied otherwise without departing from such principles.

What is claimed is:

1. A lubricant and particle combination, comprising:

a lubricant or grease base; and particles of two different particle sizes in said lubricant or grease base, a difference between the sizes of said particles of two different particle sizes being in the range of 1:100 or higher to provide coarser particles and finer particles, said coarser particles having a lower dissolution temperature in the lubricant than do the finer particles.

2. A lubricant in accordance with claim 1, wherein the coarser particles have a dissolution temperature of approx. 80–100° C. in the lubricant and the finer particles have a dissolution temperature or approx. 120° C. or higher.

3. A lubricant in accordance with claim 1, wherein the particles have a rounded shape.

4. A lubricant in accordance with claim 1, wherein the particles are solid-lubricant particles.

5. A lubricant in accordance with claim 4, wherein the particles are polymers.

6. A lubricant in accordance with claim 5, wherein the particles consist of polyethylene (PE), polyamide (PA) and/or poly[t]etrafluoroethylene (PTFE).

7. A lubricant in accordance with claim 1, wherein the particles of different size have different (apparent) surface tensions.

8. A lubricant in accordance with claim 7, wherein the coarser particles have a higher (apparent) surface tension than the finer particles.

9. A lubricant in accordance with one of the claim 7, wherein the surface tension is changed by means of a friction modifier.

10. A lubricant in accordance with one of the claim 9, wherein the surface tension is changed by means of a friction modifier.

11. A process for providing a lubricated joint, the process comprising:

providing a lubricant with particles of two different particle sizes with a difference between the sizes of said particles of two different particle sizes being in the range of 1:100 or higher to provide coarser particles and finer particles, said coarser particles having a lower dissolution temperature in the lubricant than do the finer particles.

12. A process according to claim 11, wherein after the particles become dissolved in the lubricant the particles no longer reappear after the lubricant is cooled to below the dissolution temperature.

13. A process according to claim 12, further comprising heating and holding the lubricant at the dissolution temperature of the coarser particles and subsequently cooling such that the coarser particles are no longer present as such.

14. A process according to claim 13, further comprising:

disposing said lubricant in a ball and socket joint with said coarser particles maintaining a ball socket with a bearing shell at a spaced location from the ball to provide a gap during a deformation of the hollow cylindrical ball socket to enclose the ball of the ball-and-socket joint seated in the ball socket and wherein said step of heating is performed after deformation such that the coarser particles dissolve, whereas the finer particles with the higher dissolution temperature continue to be present.

15. A process according to claim 14, further comprising: setting said gap between the ball socket and the ball after the deformation of the ball socket by selecting the diameter of the coarser particles.

16. A process according to claim 15, further comprising:

using polyacetate as the material of the bearing shell;

using polyethylene as the material of the coarser particles; and using polyamide as the material of the finer particles.

17. A lubricant and particle combination, comprising:

a lubricant or grease base;

solid-lubricant particles of a first particle size range defining course particles having a first particle dissolution temperature, the course particles being in said lubricant or grease base; and solid-lubricant particles of a second particle size range defining fine particles having a second particle dissolution temperature, the fine particles being in said lubricant or grease base, a difference between the sizes of said fine particles and said course particles being in the range of 1:100 or higher and said first particle dissolution temperature being lower in the lubricant than said second particle dissolution temperature.

18. A lubricant and particle combination in accordance with claim 17, wherein the coarser particles have a dissolution temperature of approx. 80–100° C. in the lubricant and the finer particles have a dissolution temperature or approx. 120° C. or higher.

* * * * *